US012104131B2

(12) United States Patent
Hemberger et al.

(10) Patent No.: US 12,104,131 B2
(45) Date of Patent: Oct. 1, 2024

(54) GASOLINE FUEL COMPOSITION

(71) Applicant: SHELL OIL COMPANY, Houston, TX (US)

(72) Inventors: Yasmin Verena Hemberger, Hamburg (DE); Jens Strunk, Hamburg (DE); Jens Krueger-Venus, Hamburg (DE); Jan-Henrik Gross, Hamburg (DE)

(73) Assignee: SHELL USA, INC., Houston, TX (US)

( * ) Notice: Subject to any disclaimer, the term of this patent is extended or adjusted under 35 U.S.C. 154(b) by 127 days.

(21) Appl. No.: 17/614,087

(22) PCT Filed: Jun. 18, 2020

(86) PCT No.: PCT/EP2020/067009
§ 371 (c)(1),
(2) Date: Nov. 24, 2021

(87) PCT Pub. No.: WO2020/254518
PCT Pub. Date: Dec. 24, 2020

(65) Prior Publication Data

US 2022/0220399 A1 Jul. 14, 2022

(30) Foreign Application Priority Data

Jun. 20, 2019 (EP) ..... 19181473

(51) Int. Cl.
*C10L 1/06* (2006.01)
*C10L 1/02* (2006.01)
(Continued)

(52) U.S. Cl.
CPC ..... *C10L 1/06* (2013.01); *C10L 1/023* (2013.01); *C10L 1/1608* (2013.01);
(Continued)

(58) Field of Classification Search
CPC .. C10L 1/1824; C10L 1/14; C10L 1/06; C10L 1/023; C10L 10/00; C10L 1/1608;
(Continued)

(56) References Cited

U.S. PATENT DOCUMENTS 5,855,629 A 1/1999 Grundy et al.
8,273,138 B2 * 9/2012 Bauldreay ..... C10G 3/49 585/14

(Continued)

FOREIGN PATENT DOCUMENTS

CN 101886003 A 11/2010
CN 102449125 A 5/2012

(Continued)

OTHER PUBLICATIONS

Office Action Received for Chinese Application No. 202080042390.2, Mailed on Sep. 2, 2022, 17 Pages(9 Pages of English Translation and 8 Pages of Official Copy).

(Continued)

*Primary Examiner* — Vishal V Vasisth
(74) *Attorney, Agent, or Firm* — SHELL USA, INC.

(57) ABSTRACT

Use of a gasoline fuel composition comprising (a) a major portion of gasoline blending components (b) from 0 vol % to 25 vol % of oxygenated hydrocarbon and (c) from 0.01 vol % to 5 vol % of a diene compound for the purpose of increasing the injection duration at the end of a 48 hour deposit formation phase in a direct injection spark ignition engine by at least 10%.

8 Claims, 1 Drawing Sheet

(51) Int. Cl.
*C10L 1/16* (2006.01)
*C10L 1/182* (2006.01)
*C10L 10/04* (2006.01)

(52) U.S. Cl.
CPC ..... *C10L 1/1824* (2013.01); *C10L 10/04* (2013.01); *C10L 2200/0423* (2013.01); *C10L 2270/023* (2013.01)

(58) Field of Classification Search
CPC ..... C10L 10/04; C10L 2200/0423; C10L 2270/023; C10L 1/1852
See application file for complete search history.

(56) References Cited

U.S. PATENT DOCUMENTS

| | | | | |
|---|---|---|---|---|
| 8,518,130 | B2 | 8/2013 | Croft et al. | |
| 8,764,854 | B1 | 7/2014 | Studzinski et al. | |
| 2003/0183554 | A1* | 10/2003 | Bazzani | C10L 1/06 585/14 |
| 2008/0172931 | A1* | 7/2008 | Bazzani | C10L 1/023 44/447 |
| 2010/0258071 | A1 | 10/2010 | Paggi et al. | |
| 2011/0041792 | A1 | 2/2011 | Felix-Moore et al. | |
| 2011/0154727 | A1 | 6/2011 | Brewer et al. | |
| 2011/0154728 | A1 | 6/2011 | Felix-Moore et al. | |
| 2015/0007489 | A1* | 1/2015 | Aubry | C10L 1/1824 44/451 |
| 2017/0321136 | A1 | 11/2017 | Orlebar et al. | |

FOREIGN PATENT DOCUMENTS

| | | | |
|---|---|---|---|
| CN | 104745249 | A | 7/2015 |
| EP | 0505801 | A1 | 9/1992 |
| WO | 2009077606 | A2 | 6/2009 |
| WO | 2010000761 | A1 | 1/2010 |
| WO | 2010028206 | A1 | 3/2010 |

OTHER PUBLICATIONS

International Search Report and Written Opinion received for PCT Patent Application No. PCT/EP2020/067009, mailed on Aug. 21, 2020, 09 pages.
Office Action Received for Chinese Application No. 202080042390.2, Mailed on Dec. 20, 2023, 14 Pages(07 Pages of English Translation and 07 Pages of Official Copy).

* cited by examiner

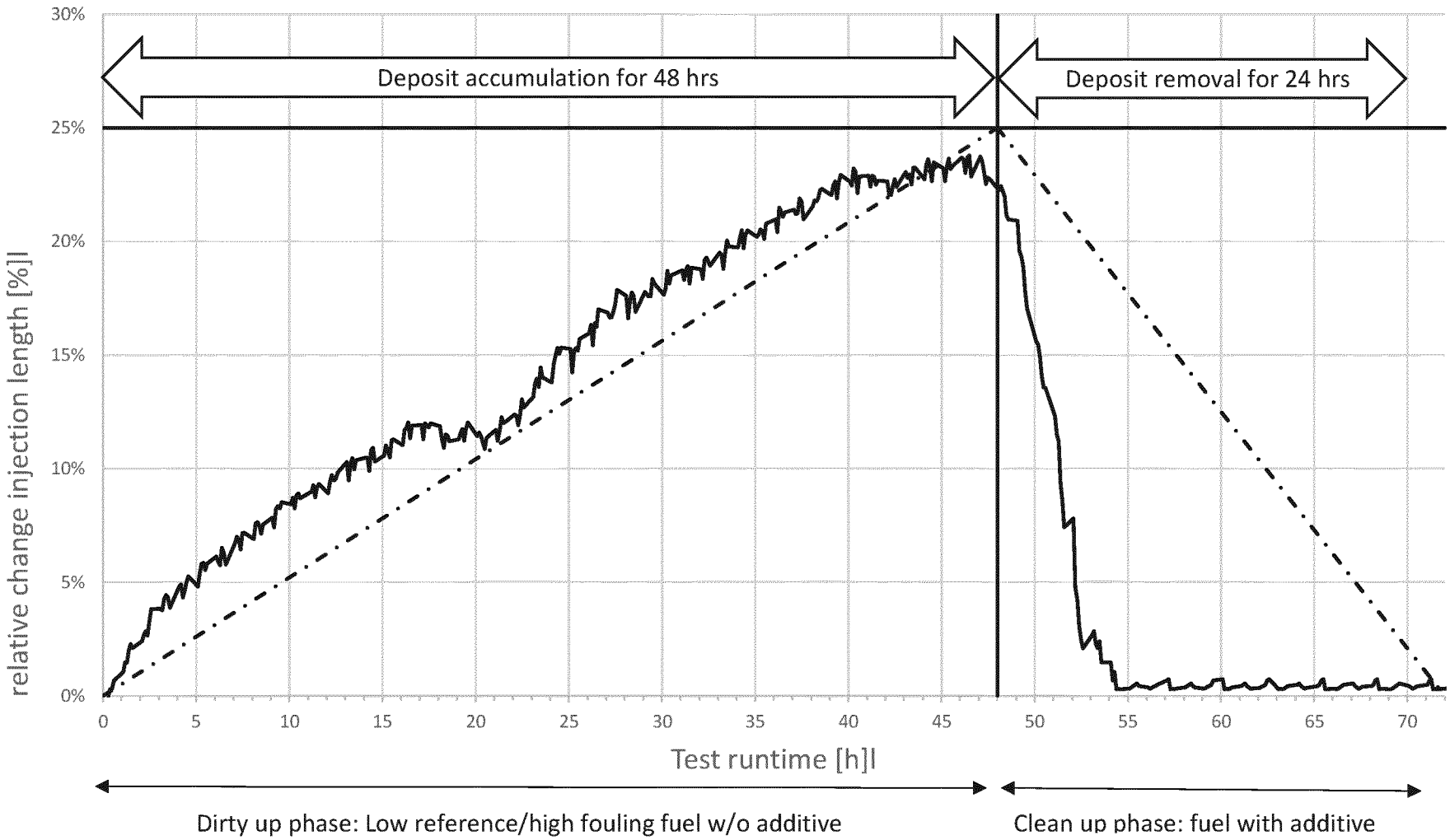
Deposit accumulation for 48 hrs
Deposit removal for 24 hrs
Dirty up phase: Low reference/high fouling fuel w/o additive
Clean up phase: fuel with additive
Test runtime [h]]
relative change injection length [%]]
0
5
10
15
20
25
30
35
40
45
50
55
60
65
70
0%
5%
10%
15%
20%
25%
30%

GASOLINE FUEL COMPOSITION

CROSS REFERENCE TO RELATED APPLICATIONS

This is a National stage application of International application No. PCT/EP2020/067009, filed 18 Jun. 2020, which claims priority of EP application No. 19181473.0, filed 20 Jun. 2019 which is incorporated herein by reference in its entirety.

FIELD OF THE INVENTION

The present invention relates to a gasoline fuel composition and in particular, to a pro-fouling gasoline fuel composition for use as a Low Reference/High Fouling fuel, i.e. a pro-fouling or 'dirty-up' fuel in the CEC TDG-F-113 test method.

BACKGROUND OF THE INVENTION

Under ideal conditions, normal combustion in a conventional spark-ignited engine occurs when a mixture of fuel and air is ignited within the combustion chamber inside the cylinder by the production of a spark originating from a spark plug. Such normal combustion is generally characterized by the expansion of the flame front across the combustion chamber in an orderly and controlled manner.

One class of spark ignition engines is the class described as direct injection spark ignition (DISI) engines (also known as gasoline direct injection (GDI) engines). Use of an unleaded base gasoline in such an engine tends to give rise to nozzle fouling in the injectors, and additives have been developed to reduce or minimize these deposits.

Certain test methods have been developed in order to screen such additives and to measure their performance in reducing or minimizing these injector deposits. One such test method is the CEC (Coordinating European Council for the Development of Performance Tests for Fuels, Lubricants and Other Fluids) industry standard test procedure, TDG-F-113. This test aims to assess the ability of a fuel treated with an additive to prevent and remove formed engine deposits.

The TDG-F-113 DISI test involves a 48 hour dirty-up phase followed by a 24 hour clean-up phase. For the dirty-up phase a pro-fouling reference gasoline fuel needs to be used, designated as "Low Reference/High Fouling Fuel' in the TDG-F-113 test method. The same pro-fouling reference fuel is treated with the additive being evaluated for use during the clean-up phase.

While attempts have been made to find a suitable pro-fouling gasoline fuel for use in this test, it would be desirable to provide an improved and stable pro-fouling gasoline reference fuel having improved fouling properties in the deposit formation phase (the so-called 'Dirty-Up' phase) of the test.

It has now surprisingly been found that the gasoline composition described hereinafter provides improved pro-fouling properties in a DISI engine at the end of a 48 hour deposit formation phase, in particular at the end of the 48 hour deposit formation phase of the CEC TDG-F-113 DISI test.

SUMMARY OF THE INVENTION

According to the present invention there is provided the use of a gasoline fuel composition comprising (a) a major portion of gasoline blending components (b) from 0% to 25 vol % of oxygenated hydrocarbon components and (c) from 0.01 vol % to 5 vol % of a diene compound for the purpose of increasing the injection duration at the end of a 48 hour deposit formation phase in a direct injection spark ignition engine by at least 10%.

According to the present invention there is further provided a gasoline fuel composition comprising (a) a major portion of gasoline blending components (b) from 0 vol % to 25 vol % of oxygenated hydrocarbon components and (c) from 0.01 vol % to 5 vol % of a diene compound, wherein the gasoline fuel composition provides an increase in injection duration at the end of a 48 hour deposit formation phase in a direct injection spark ignition engine of at least 10%.

It has surprisingly been found that the gasoline composition described herein provides improved pro-fouling performance and in particular can be used as an improved pro-fouling reference gasoline fuel (also known as a 'Low Reference/High Fouling Fuel') in the CEC TDG-F-113 DISI test.

It has also surprisingly been found that the gasoline composition described herein provides improved pro-fouling performance and in particular can be used as an improved pro-fouling reference gasoline fuel (also known as a 'Low Reference/High Fouling Fuel') in the CEC TDG-F-113 DISI test, while also meeting the requirements of the EN228 specification, especially an EN228 compliant E5 gasoline fuel.

It has also surprisingly been found that the gasoline composition described herein provides improved repeatability and reproducibility properties when used as a pro-fouling reference gasoline fuel in the CEC TDG-F-113 test.

It has further surprisingly been found that the gasoline composition described herein exhibits excellent oxidative stability.

The features and advantages of the present invention will be apparent to those skilled in the art. While numerous changes may be made by those skilled in the art, such changes are within the spirit of the invention.

BRIEF DESCRIPTION OF THE DRAWINGS

The drawings illustrate certain aspects of some of the embodiments of the invention, and should not be used to limit or define the invention.

FIG. 1 illustrates the test procedure proposed within the CEC TDG-F-113 test method and shows the impact of deposit formation and removal on injection duration time in a DISI engine.

DETAILED DESCRIPTION OF THE INVENTION

The gasoline fuel composition for use herein comprises gasoline blending components, such as a gasoline base fuel or a mixture of individually selected gasoline blending components, suitable for use in an internal combustion engine, oxygenated hydrocarbon components and a diene compound.

It has now surprisingly been found that the gasoline composition described herein provides improved pro-fouling properties in a DISI engine during a deposit formation phase, in particular at the end of the 48 hour deposit formation phase of the CEC TDG-F-113 DISI test.

Details of the CEC TDG-F-113 DISI test can be found at the following website: https://www.cectests.org/public/info/ g003/Appendix %201_C EC %20New %20Test %20Development %20-%20Terms %20 of %20Reference %20-TDG-F-113.pdf The CEC TDG-F-113 test includes a 48 hour so-called 'dirty-up' phase where a pro-fouling gasoline composition (known as a 'Low Reference/High Fouling Fuel' in the CEC TDG-F-113 test) is used in a DISI engine for 48 hours in order to produce injector and other engine deposits.

The gasoline fuel composition is used herein for the purpose of increasing the injector pulse width, i.e. the injection duration at the end of a 48 hour deposit formation phase in a direct injection spark ignition engine by at least 10%, preferably by at least 15%, more preferably by at least 20%, in particular wherein the 48 hour deposit formation phase is the 48 hour 'Dirty-Up' phase of the CEC TDG-F-113 test. As used herein, the increase in injection duration is as compared to the injection duration measured at the start of the 48 hour deposit formation phase.

The CEC TDG-F-113 test comprises a 48 hour 'Dirty-Up' phase and aims for a 25% injector pulse width increase, i.e. the injection duration at the end of the 48 hour 'Dirty-Up' phase. The CEC TDG-F-113 test also comprises a 24 hour 'Clean-Up' phase. The pro-fouling reference fuel used during the dirty-up phase should be EN228 compliant, preferably containing 3-5% ethanol, (i.e. an E5 EN228 compliant fuel). The same pro-fouling fuel used for the 'Dirty-Up' phase will be treated with the additive being evaluated for use during the 'Clean-Up' phase.

As used herein the term 'injection duration' means the period of time during which fuel enters the combustion chamber from the injector, i.e. the duration from the start of the injection (SOI) until the injector needle closes.

'Injection duration' can be measured according to the method described in the CEC TDG-F-113 test.

An essential component of the gasoline compositions herein is a diene compound. In one embodiment of the present invention, the diene compound is present in the gasoline composition at a level of from 0.01 vol % to 5 vol %, preferably from 0.05 vol % to 3 vol %, more preferably from 0.1 vol % to 2 vol %, even more preferably from 0.1 vol % to 1 vol %, and especially from 0.2 vol % to 0.8 vol %, based on the gasoline composition.

In another embodiment of the present invention, the diene compound is present in the gasoline composition at a level of 0.15 vol % to 5 vol %, preferably from 0.15 vol % to 3 vol %, more preferably from 0.2 vol % to 3 vol %, even more preferably from 0.5 vol % to 3 vol %, based on the gasoline composition.

In a preferred embodiment herein, the diene compound is present in the gasoline composition at a level of 0.5 vol %.

It is known to those skilled in the art that gasoline blending components, such as a gasoline base fuel, may already comprise dienes at low levels. Therefore the vol % ranges of dienes provided herein are the levels of dienes which are included in the gasoline fuel composition in addition to those which may already be present in the gasoline blending components, such as a gasoline base fuel.

The diene compound can be any diene compound suitable for use in a gasoline fuel composition. The diene compound is preferably selected from 1,3-butadiene, 2-methyl-1,3-butadiene (isoprene), 1,3-pentadiene, 1,3-hexadiene, 1,5-hexadiene, 2,4-hexadiene, 2-methyl-1,3-pentadiene, 2-methyl-2,4-pentadiene, dicyclopentadiene, cyclopentadiene, 7-Methyl-3-methylen-1,6-octadiene and mixtures thereof. A particularly preferred diene compound for use herein is dicyclopentadiene.

In addition to the diene compound, the gasoline fuel composition of the present invention preferably comprises oxygenated hydrocarbon at a level of 0 to 25 vol %, more preferably at a level of 0.1 to 20 vol %, even more preferably at a level of from 1 to 10 vol %, and especially at a level of from 2 to 8 vol %, based on the gasoline fuel composition.

It is known to those skilled in the art that gasoline blending components, such as a gasoline base fuel, may already comprise oxygenated hydrocarbons at low levels. Therefore the vol % ranges of oxygenated hydrocarbons provided herein are the levels of oxygenated hydrocarbons which are included in the gasoline fuel composition in addition to those which may already be present in the gasoline blending components, such as a gasoline base fuel.

In one embodiment herein, the gasoline fuel composition is free of oxygenated hydrocarbons (i.e. contains 0 vol % of oxygenated hydrocarbons in addition to those already present in the gasoline blending components).

In a particular preferred embodiment, the oxygenated hydrocarbon is present in the gasoline fuel composition at a level of 5 vol %.

Examples of suitable oxygenated hydrocarbons that may be incorporated into the gasoline fuel composition include alcohols, ethers, esters, ketones, aldehydes, carboxylic acids and their derivatives, and oxygen containing heterocyclic compounds, and mixtures thereof. In one embodiment of the present invention the oxygenated hydrocarbon is selected from alcohols, ethers and esters, and mixtures thereof.

Suitable alcohols for use herein include methanol, ethanol, propanol, 2-propanol, butanol, tert-butanol, iso-butanol, 2-butanol and mixtures thereof. Suitable ethers for use herein include ethers containing 5 or more carbon atoms per molecule, e.g., methyl tert-butyl ether and ethyl tert-butyl ether, and mixtures thereof. Suitable esters for use herein include esters containing 5 or more carbon atoms per molecule.

In a preferred embodiment of the present invention the oxygenated hydrocarbon is selected from alcohols, ethers and mixtures thereof. In an especially preferred embodiment of the present invention, the oxygenated hydrocarbon is selected from alcohols. A particularly preferred oxygenated hydrocarbon for use herein is ethanol.

In a particularly preferred embodiment, the gasoline fuel composition herein is EN228 compliant and also comprises ethanol, preferably at a level of 5 vol % (E5).

In addition to the diene compound and the oxygenated hydrocarbon component, the fuel compositions for use herein comprise a major portion of gasoline blending components, such as a gasoline base fuel or as a mixture of individual gasoline blending components, suitable for use in an internal combustion engine.

The term "comprises" as used herein is intended to indicate that as a minimum the recited components are included but that other components that are not specified may also be included as well.

The gasoline blending components may be any gasoline blending components suitable for use in an internal combustion engine of the spark-ignition (gasoline) type known in the art, including automotive engines as well as in other types of engine such as, for example, off road and aviation engines. A preferred engine in the context of the present invention is a direct injection spark ignition engine.

In one embodiment, the gasoline blending components may be provided as a gasoline base fuel. The gasoline used as the base fuel in the liquid fuel composition of the present invention may conveniently also be referred to as 'base gasoline'.

The gasoline base fuel may itself comprise a mixture of two or more different gasoline fuel components, and/or be additivated as described below.

Gasoline base fuels typically comprise mixtures of hydrocarbons boiling in the range from 25 to 230° C. (EN-ISO 3405), the optimal ranges and distillation curves typically varying according to climate and season of the year. The hydrocarbons in a gasoline may be derived by any means known in the art, conveniently the hydrocarbons may be derived in any known manner from straight-run gasoline, synthetically-produced aromatic hydrocarbon mixtures, thermally or catalytically cracked hydrocarbons, hydrocracked petroleum fractions, catalytically reformed hydrocarbons or mixtures of these.

The specific distillation curve, hydrocarbon composition, research octane number (RON) and motor octane number (MON) of the gasoline are not critical.

Conveniently, the research octane number (RON) of the gasoline base fuel may be at least 80, for instance in the range of from 80 to 110. Typically, the RON of the gasoline base fuel will be at least 90, for instance in the range of from 90 to 110. Typically, the RON of the gasoline base fuel will be at least 91, for instance in the range of from 91 to 105 (EN 25164). The motor octane number (MON) of the gasoline may conveniently be at least 70, for instance in the range of from 70 to 110. Typically, the MON of the gasoline will be at least 75, for instance in the range of from 75 to 105 (EN 25163).

The liquid fuel composition according to the present invention has a Research Octane Number (RON) in the range of from 85 to 105, for example meeting the European specifications of 95 or premium product grade of 98. The liquid fuel composition used in the present invention has a Motor Octane Number in the range of from 75 to 90.

In a preferred embodiment of the present invention, the gasoline blending components comprise a mixture of specially selected individual gasoline blending components such as, for example, a blend of one or more of saturated hydrocarbons, aromatic hydrocarbons, heavy reformate, alkylate or alkylate blend and LCC (light cat cracked).

The gasoline blending components are present in the gasoline fuel composition in a major portion, for example in an amount of greater than 50% m/m of the gasoline fuel composition, and may be present in an amount of up to 90% m/m, or 95% m/m.

A preferred gasoline fuel composition herein comprises an aromatic hydrocarbon at a level in the range from 10 to 60% v/v based on the gasoline fuel composition; preferably in the range of from 10 to 50% v/v based on the gasoline, more preferably in the range from 20 to 40% v/v based on the gasoline fuel composition.

Suitable aromatic hydrocarbons for use in the composition herein include toluene and xylene, and mixtures thereof. A preferred gasoline composition herein comprises a mixture of toluene and xylene.

In a preferred gasoline composition herein, toluene is present at a level from about 10 vol %, preferably from about 15 vol %, to at most 40 vol %, preferably to at most 30 vol %.

In a preferred gasoline composition herein, xylene is present at a level from about 5 vol %, preferably from about 8 vol %, to at most 20 vol %, preferably to at most 15 vol %.

The benzene content of the gasoline fuel composition is at most 10% v/v, more preferably at most 5% v/v, especially at most 1% v/v based on the gasoline fuel composition.

Preferably, the gasoline fuel composition of the present invention comprises C5 paraffins at a level of from 5 vol % to 30 vol %, preferably from 5 vol % to 20 vol %, more preferably from 10 vol % to 20 vol %. It should be noted that the alkylate or alkylate blend described below also contains C5 isoparaffins and the amount of C5 paraffins specified here is the amount of C5 paraffins not including the C5 isoparaffins which is part of the alkylate or alkylate blend.

Preferred C5 paraffins for use herein include n-pentane and iso-pentane, and mixtures thereof. The total isopentane content in the gasoline fuel composition is preferably in the range of 2 vol % to 10 vol %, more preferably 3 vol % to 8 vol %. The total n-pentane content in the gasoline fuel composition is preferably in the range of from 5 vol % to 15 vol %, more preferably in the range from 8 vol % to 12 vol %.

In a preferred embodiment herein, the gasoline fuel composition comprises an alkylate or alkylate blend. The term alkylate typically refers to branched-chain paraffin. The branched-chain paraffin typically is derived from the reaction of isoparaffin with olefin. Various grades of branched chain isoparaffins and mixtures are available. The grade is identified by the range of the number of carbon atoms per molecule, the average molecular weight of the molecules, and the boiling point range of the alkylate. It has been found that a certain cut of alkylate stream and its blend with paraffins and isoparaffins such as n-pentane and isopentane is desirable to obtain or provide the advantages of the invention. These alkylate or alkylate blend can be obtained by distilling or taking a cut of standard alkylates available in the industry. The alkylate or alkylate blend used herein preferably has an initial boiling range of from about 32° C. to about 60° C. and a final boiling range of from about 105° C. to about 140° C., preferably to about 135° C., more preferably to about 130° C., most preferably to about 125° C., having T40 of less than 99° C., preferably at most 98° C., T50 of less than 100° C., T90 of less than 110° C., preferably at most 108° C., the alkylate or alkylate blend comprising isoparaffins from 4 to 9 carbon atoms, about 3-20 vol % of C5 isoparaffins, based on the alkylate or alkylate blend, about 3-15 vol % of C7 isoparaffins, based on the alkylate or alkylate blend, and about 60-90 vol % of C8 isoparaffins, based on the alkylate or alkylate blend, and less than 1 vol % of C10+, preferably less than 0.1 vol %, based on the alkylate or alkylate blend. Alkylate or alkylate blend is preferably present in the blend in an amount from about above 30 vol %, preferably at least about 32 vol %, most preferably at least about 35 vol % to at most about 55 vol %, preferably to at most about 50 vol %, more preferably to at most about 45 vol %, based on the gasoline fuel composition.

The gasoline fuel composition preferably comprises a heavy reformate at a level of from 2 vol % to 10 vol %, preferably at a level of from 4 vol % to 7 vol %, based on the total gasoline fuel composition.

The gasoline fuel composition preferably comprises an LCC (light cat cracked) gasoline stream at a level of from 5 vol % to 15 vol %, more preferably from 8 vol % to 12 vol %, based on the total gasoline fuel composition.

The gasoline fuel composition preferably has a low or ultra low sulphur content, for instance at most 1000 mg/kg (otherwise known as ppm or ppmw or parts per million by weight), preferably no more than 500 mg/kg, more preferably no more than 100, even more preferably no more than 50 and most preferably no more than even 10 mg/kg. The EN228 specification requires a sulphur content of lower than 10 ppm.

The gasoline also preferably has a low total lead content, such as at most 0.005 g/l, most preferably being lead free—having no lead compounds added thereto (i.e., unleaded).

Also suitable for use herein are gasoline blending components which can be derived from a biological source. Examples of such gasoline blending components can be found in WO2009/077606, WO2010/028206, WO2010/000761, European patent application nos. 09160983.4, 09176879.6, 09180904.6, and U.S. patent application Ser. No. 61/312,307.

In the above, amounts (concentrations, % v/v, mg/kg (ppm), % m/m) of components are of active matter, i.e., exclusive of volatile solvents/diluent materials.

Whilst not critical to the present invention, the base gasoline or the gasoline composition of the present invention may conveniently include one or more optional fuel additives. The concentration and nature of the optional fuel additive(s) that may be included in the base gasoline or the gasoline composition used in the present invention is not critical. Non-limiting examples of suitable types of fuel additives that can be included in the base gasoline or the gasoline composition used in the present invention include anti-oxidants, corrosion inhibitors, antiwear additives or surface modifiers, flame speed additives, detergents, dehazers, antiknock additives, metal deactivators, valve-seat recession protectant compounds, dyes, solvents, carrier fluids, diluents and markers. Examples of suitable such additives are described generally in U.S. Pat. No. 5,855,629.

Conveniently, the fuel additives can be blended with one or more solvents to form an additive concentrate, the additive concentrate can then be admixed with the base gasoline or the gasoline composition of the present invention.

The (active matter) concentration of any optional additives present in the base gasoline or the gasoline composition of the present invention is preferably up to 1 percent by weight, more preferably in the range from 5 to 2000 ppmw, advantageously in the range of from 300 to 1500 ppmw, such as from 300 to 1000 ppmw.

The fuel compositions may be conveniently prepared using conventional formulation techniques by admixing the diene compound and the oxygenated hydrocarbon with the gasoline blending components and optionally one or more additive components.

To facilitate a better understanding of the present invention, the following examples of certain aspects of some embodiments are given. In no way should the following examples be read to limit, or define, the entire scope of the invention.

Examples

Three pro-fouling 'dirty-up' fuel formulations were produced by blending the components set out in Table 1 below. The RON for all fuels was 99 and the MON for all fuels was 88.

TABLE 1

| Component | Fuel A* Vol % | Fuel B Vol % | Fuel C Vol % |
|---|---|---|---|
| Alkylate | to 100% | to 100% | to 100% |
| Heavy Reformate | 4.975 | 4.975 | 4.975 |
| LCC (light cat cracked) gasoline stream | 9.95 | 9.95 | 9.95 |
| Xylene | 9.95 | 9.95 | 9.95 |
| Iso-pentane | 4.975 | 4.975 | 4.975 |
| n-pentane | 9.95 | 9.95 | 9.95 |
| Toluene | 19.41 | 19.41 | 19.41 |

TABLE 1-continued

| Component | Fuel A* Vol % | Fuel B Vol % | Fuel C Vol % |
|---|---|---|---|
| Dicyclopentadiene | 0 | 0.5 | 3 |
| Ethanol | 5 | 5 | 0 |

*not according to the invention

The fuel compositions of Table 1 were used as pro-fouling reference fuels in the 48 hour dirty-up phase of the CEC TDG-F-113 test and the increase in injection duration was measured for each fuel as described in the CEC TDG-F-113 test method. Further, oxidation stability was measured according to EN ISO 7536. The results are shown in Table 2 below.

TABLE 2

| | Fuel A | Fuel B | Fuel C |
|---|---|---|---|
| % Increase in injection duration | 9 | 23 | >25 |
| Oxidation Stability | nm | >1000 min | nm |

nm = not measured

Discussion

Fuel A (not containing any dicyclopentadiene) provided a 9% increase in injection duration, while Fuel B (containing 0.5 vol % dicyclopentadiene) and Fuel C (containing 3 vol % dicyclopentadiene) provided a 23% and >25% increase in injection duration, respectively. Further, Fuel B exhibited excellent oxidation stability (oxidation stability after 1 year was still >1000 min). In addition, the fuel compositions of the present invention exhibited a stable fouling signal over a period of 12 months.

In addition, for Fuel B it was observed that during the 48 hour deposit formation phase there was a significant increase in particulate emissions compared to that at the start of the deposit formation phase (ranging from around a 350% increase to around a 900% increase over the duration of the deposit formation phase).

We claim:

1. A method for increasing the injection duration at the end of a 48 hour deposit formation phase in a direct injection spark ignition engine by at least 10%, wherein the method comprises fueling the direct injection engine with a gasoline fuel composition comprising (a) greater than 50% m/m of gasoline blending components comprising a blend of (i) saturated hydrocarbons comprising C5 paraffins selected from isopentane and n-pentane, and mixtures thereof, wherein the C5 paraffins are present at a level of 10 vol % to 20 vol %, based on the gasoline fuel composition, (ii) aromatic hydrocarbons selected from toluene and xylene, and mixtures thereof, wherein the aromatic hydrocarbons are present at a level of 20 vol % to 40 vol %, based on the gasoline fuel composition, (iii) heavy reformate, (iv) alkylate or alkylate blend and (v) LCC; (b) from 1 vol % to 10 vol % of oxygenated hydrocarbon wherein the oxygenated hydrocarbon is ethanol and (c) from 0.15 vol % to 3 vol % of a diene compound, wherein the 48 hour deposit formation phase is the 48 hour dirty-up phase of the CEC TDG-F-113 test.

2. A method according to claim 1 wherein the injection duration at the end of a 48 hour deposit formation phase in a direct injection spark ignition engine is increased by at least 15%.

3. A method according to claim 1 wherein the injection duration at the end of a 48 hour deposit formation phase in a direct injection spark ignition engine is increased by at least 20%.

4. A method according to claim 1 wherein the gasoline fuel composition comprises from 0.2 to 3 vol % of the diene compound.

5. A method according to claim 1 wherein the diene compound is selected from 1,3-butadiene, 2-methyl-1,3-butadiene (isoprene), 1,3-pentadiene, 1,3-hexadiene, 1,5-hexadiene, 2,4-hexadiene, 2-methyl-1,3-pentadiene, 2-methyl-2,4-pentadiene, dicyclopentadiene, cyclopentadiene, 7-methyl-3-methylen-1,6-octadiene, and mixtures thereof.

6. A method according to claim 1 wherein the diene compound is dicyclopentadiene.

7. A method according to claim 1 wherein the gasoline fuel composition meets the EN228 specification for gasoline fuels.

8. A method according to claim 1 wherein the gasoline fuel composition comprises from 0.2 vol % to 0.8 vol % of the diene compound.

* * * * *